US008956082B2

(12) United States Patent
Nelson

(10) Patent No.: US 8,956,082 B2
(45) Date of Patent: Feb. 17, 2015

(54) ROCK BOLTING SYSTEM, METHOD OF INSTALLING ROCK BOLTS, AND FLEXIBLE BOLT CENTRALIZER

(71) Applicant: Yves Nelson, Ontario (CA)

(72) Inventor: Yves Nelson, Ontario (CA)

(73) Assignee: 1311854 Ontario Limited, Ontario (CA)

( * ) Notice: Subject to any disclaimer, the term of this patent is extended or adjusted under 35 U.S.C. 154(b) by 148 days.

(21) Appl. No.: 13/658,017

(22) Filed: Oct. 23, 2012

(65) Prior Publication Data

US 2014/0112724 A1 Apr. 24, 2014

(51) Int. Cl.
*E21D 20/00* (2006.01)

(52) U.S. Cl.
CPC ..... *E21D 20/003* (2013.01); *E21D 20/00* (2013.01)
USPC ..... 405/259.1

(58) Field of Classification Search
USPC ..... 405/259.1, 303
See application file for complete search history.

(56) References Cited

U.S. PATENT DOCUMENTS

| | | | | |
|---|---|---|---|---|
| 4,226,559 | A * | 10/1980 | Prebensen | 405/303 |
| 4,497,378 | A * | 2/1985 | Beney et al. | 173/32 |
| 6,598,309 | B1 * | 7/2003 | Coombs | 33/644 |
| 2003/0066665 | A1 * | 4/2003 | Coombs et al. | 173/32 |

* cited by examiner

*Primary Examiner* — Benjamin Fiorello
*Assistant Examiner* — Kyle Armstrong
(74) *Attorney, Agent, or Firm* — Allen J. Moss; Squire Patton Boggs (US) LLP

(57) ABSTRACT

A rock bolting system comprises independently movable hydraulic stinger, drill feed and bolting feed. The stinger is hydraulically extended to sting or engage the face of the rock. With the stinger stinging the rock face, the drill feed drills a hole in the rock. With the stinger still stinging the rock face, the bolting feed is indexed into position and a rock bolt is installed in the hole. A flexible elastomeric bolt centralizer may be mounted to the bolting feed to guide the rock bolt into the hole drilled by the drill feed.

11 Claims, 9 Drawing Sheets

ROCK BOLTING SYSTEM, METHOD OF INSTALLING ROCK BOLTS, AND FLEXIBLE BOLT CENTRALIZER

CROSS-REFERENCE TO RELATED APPLICATIONS

This application claims the benefit of priority from Canadian Patent Application Serial No. 2,792,592 filed in the name of Yves Nelson on Oct. 22, 2012, and entitled "Rock Bolting System, Method of Installing Rock Bolts, and Flexible Bolt Centralizer," the contents of which are incorporated by reference.

TECHNICAL FIELD

The present invention relates generally to mining equipment and, in particular, to rock bolting.

BACKGROUND

In a mine, ground support, e.g. rock bolts and screening, is used to prevent rock falls. Several different types of rock bolts may be used but all require that holes be drilled in the rock first. This is done with equipment known as rock bolters. These are mobile units with a bolting head attached. To drill a hole in the rock to install ground support, the bolting head is placed against the rock face (which is called "stinging the face") and then a hole is drilled into the rock. The unit is then indexed to install the ground support.

Conventionally, the bolter feeds have a fixed stinger. This is the part of the feed that stabilizes the feed assembly against the rock during the drilling process. With the conventional systems, the whole feed assembly must move to the rock face. In other words, in conventional rock bolter systems, the rock drill feed and the bolting feed are connected together and thus extend and retract. This is problematic in tight areas and in some cases makes indexing difficult.

A need therefore exists for an effective solution to this technical problem.

SUMMARY

In broad terms, the present invention provides a novel rock bolting system, a novel method of installing rock bolts, and a novel flexible bolt centralizer.

The system in accordance with the present invention has independently movable feeds to enable the system to operate in confined spaces. In other words, the system has independently extendable and retractable hydraulic stinger, drilling feed and bolting feed. This system therefore enables the operator to sting the face using the hydraulic stinger without having to move the entire assembly. This system facilitates stinging in tight places. The drill and bolter feeds can remain retracted to make indexing possible. With the optional addition of a gripping mechanism and a rotation element, this system may also function as a screen handler for the installing of screening over a rock face.

Accordingly, one aspect of the present invention is a rock bolting system comprising a hydraulic stinger for engaging a rock face to stabilize the rock bolting system, a drill feed for drilling a hole in the rock face, and a bolting feed for installing a rock bolt into the hole, wherein the hydraulic stinger, the drill feed and the bolting feed are each independently extendable and retractable.

Another aspect of the present invention is a method of installing ground support using a rock bolting system having a hydraulic stinger, a drill feed, and a bolting feed. The method entails independently extending the hydraulic stinger to engage a rock face while the drill feed and bolting feed remain retracted, and then, while the hydraulic stinger is extended, independently extending the drill feed. The method then involves drilling a hole in the rock with the hydraulic stinger engaging the rock face, indexing the system to rotate the bolting feed into alignment with the hole with the hydraulic stinger engaging the rock face, and installing a rock bolt into the hole using the bolting feed.

Yet another aspect of the present invention is a bolt centralizer for a bolting feed in a rock bolt system. The bolt centralizer comprises a flexible body capable of elastically flexing from an upright posture for centralizing a rock bolt to a folded posture that permits a bolting feed to advance. The centralizer comprises a passage for guiding the rock bolt into a hole drilled by the rock bolt system. The centralizer comprises a base for fastening the centralizer to a sliding carriage that is adapted to slide over the rails of the bolting feed.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals. It should furthermore be noted that the drawings are not necessarily to scale.

DETAILED DESCRIPTION

Figures 1, 2, 3, 4:
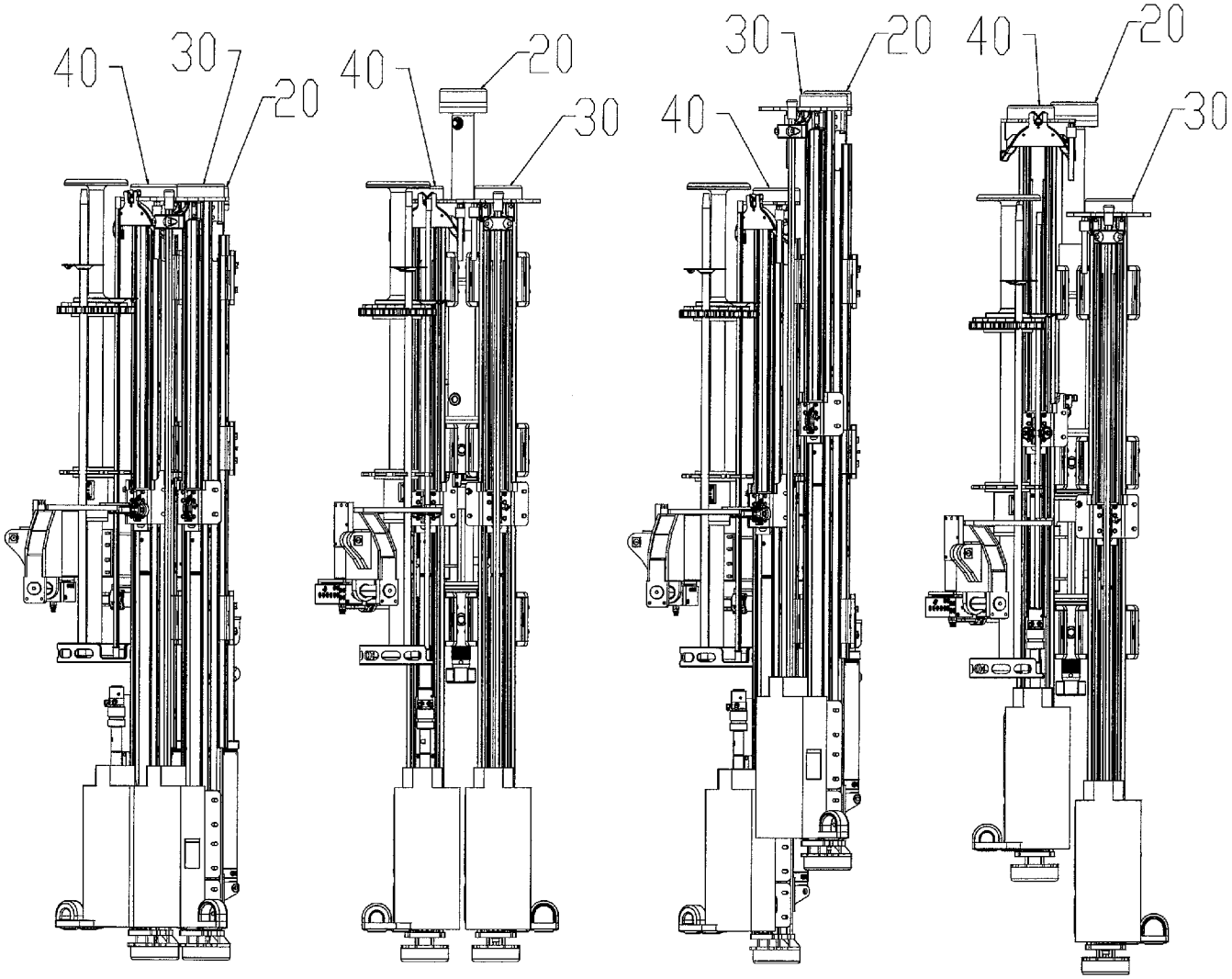
FIG. 1 is a top view of a rock bolting system with the hydraulic stinger, drill feed and bolting feed all retracted.
FIG. 2 is a top view of the rock bolting system after rotation relative to the posture of FIG. 1 showing the hydraulic stinger extended and the drill and bolting feeds retracted.
FIG. 3 is a top view of the rock bolting system of FIG. 1 showing the hydraulic stinger and drill feed extended and the bolting feed retracted.
FIG. 4 is a top view of the rock bolting system after rotation relative to the posture of FIG. 3 showing the hydraulic stinger and bolting feed extended and the drill feed retracted.

By way of introduction, the present invention provides a novel rock bolting system, a novel method of installing rock bolts, and a novel flexible bolt centralizer. The present invention provides improvements in the field of ground support.

Rock Bolter

In general, a rock bolter is designed to drill a hole and then to install a rock bolt into the hole. For the purposes of the present specification, the term "rock bolt" is meant to encompass rebar, split sets, expandable bolts, anchors or any other bolt-like elements designed to be installed in a hole in a rock face to provide ground support.

With reference to FIGS. 1-4, the rock bolter (or rock bolting system), which is generally designated by reference numeral 10, has a hydraulic stinger 20, a drill feed 30 and a bolting feed 40. Each is hydraulically actuated using a hydraulic actuator (hydraulic cylinder, piston and rod). In the embodiments of the present invention, each of the stinger, drill feed and bolting feed is independently movable (i.e. each is independently extendable and retractable). In operation, the rock bolter is brought close to a rock face. A rock face means either the roof or the walls of a mine. Once the rock bolter is properly positioned relative to the rock face, the rock bolter extends the stinger to sting the rock face. Stinging the rock face means engaging or contacting the rock face. Stinging is done to stabilize the rock bolter. Therefore, stinging requires that the stinger press against the rock face with sufficient force to stabilize the rock bolter. With the stinger engaged against the rock face, the rock bolter then extends the drill feed to drill a hole in the rock. The drill is withdrawn by retracting the drill feed while the stinger remains in contact with the rock face. The rock bolter is indexed to rotate the bolting feed into alignment with the hole. The bolting feed is then extended (with the stinger still engaging the rock face). The stinger ensures that the bolting feed remains aligned with the hole drilled by the drill feed. The bolting feed then installs the rock bolt into the hole drilled by the drill feed. The bolting feed is extended while the stinger is extended and the drill feed is retracted. After bolting, the bolting feed may be retracted. The stinger may then be retracted. The installation of the rock bolt is complete. The rock bolter may be moved to a new location to drill another hole and install another rock bolt.

FIG. 1 is a top view of a rock bolter or rock bolting system 10 with the hydraulic stinger 20, drill feed 30 and bolting feed 40 all retracted. The stinger, drill feed and bolting feed are all retracted into the retracted posture shown in FIG. 1 when the rock bolter is stored, transported or when maneuvered in tight spaces. At the outset of a rock bolting operation, the rock bolter is in this posture.

FIG. 2 is a top view of the rock bolting system after rotation about a longitudinal axis. FIG. 2 shows the hydraulic stinger 20 extended and the drill feed 30 and bolting feed 40 retracted. FIG. 2 thus shows the posture of the rock bolter when the stinger is extended to sting the rock face.

FIG. 3 is a top view of the rock bolting system showing the hydraulic stinger and drill feed extended and the bolting feed retracted. FIG. 3 thus shows the posture of the rock bolter when the drill feed is extended to drill the hole. Drilling is performed while the stinger is extended against the rock face to stabilize the rock bolter. Note that FIG. 3 shows the same non-rotated posture of FIG. 1.

FIG. 4 is a top view of the rock bolting system in the same rotated posture as FIG. 2. FIG. 4 shows the hydraulic stinger and bolting feed extended and the drill feed retracted. FIG. 4 shows the rock bolter after the hole has been drilled and the drill feed has been retracted and after the bolting feed has been extended to install the rock bolt into the hole.

Figure 7:
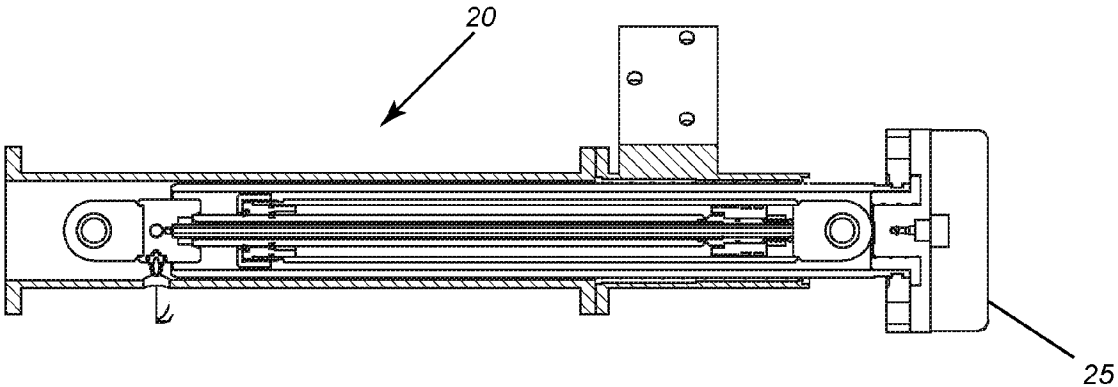
FIG. 7 is cross-sectional view of the hydraulic stinger in its retracted posture.
Figure 8:
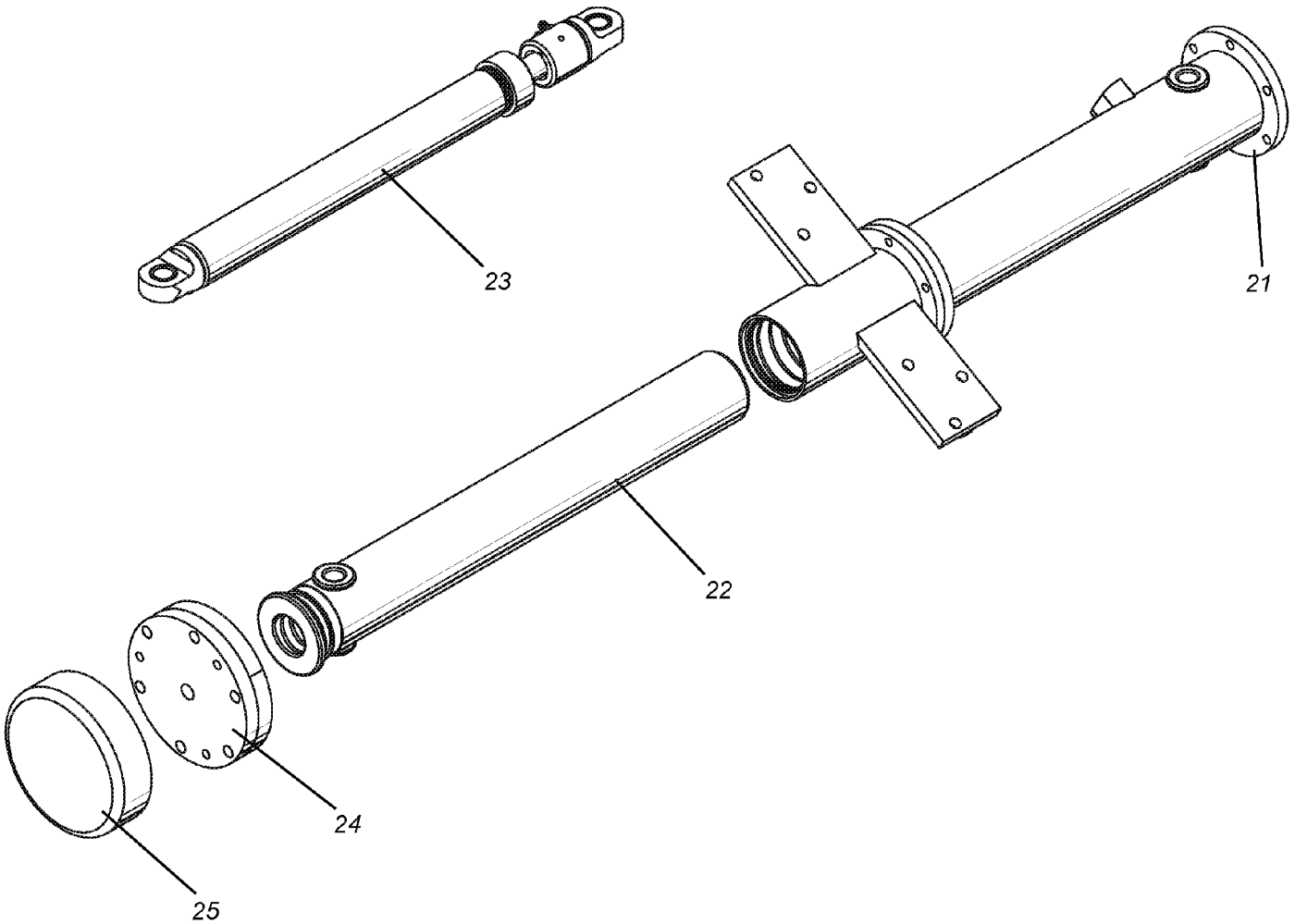
FIG. 8 is an exploded view of the hydraulic stinger.
Figure 9:
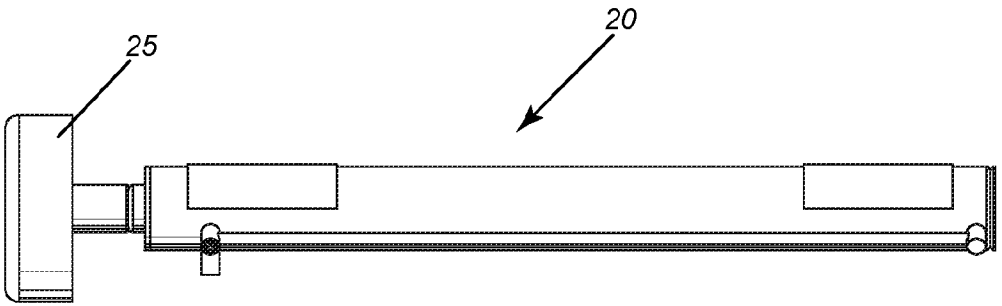
FIG. 9 is side view of a variant of the (retracted) hydraulic stinger in which the support tube is the cylinder.
Figure 10:
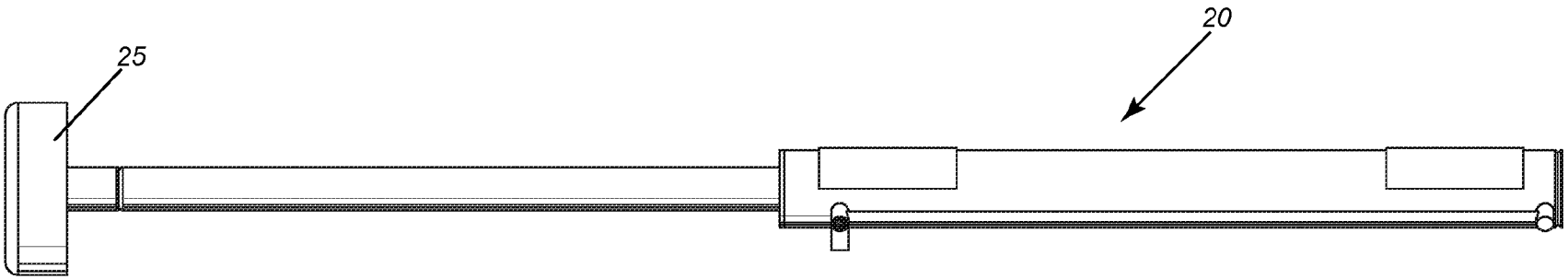
FIG. 10 is a side view of the variant of FIG. 9 in its extended posture.

The hydraulic stinger 20 described above may be constructed in accordance with a first embodiment shown in FIGS. 5-8 or in accordance with a second embodiment shown in FIGS. 9-10.

Figure 5:
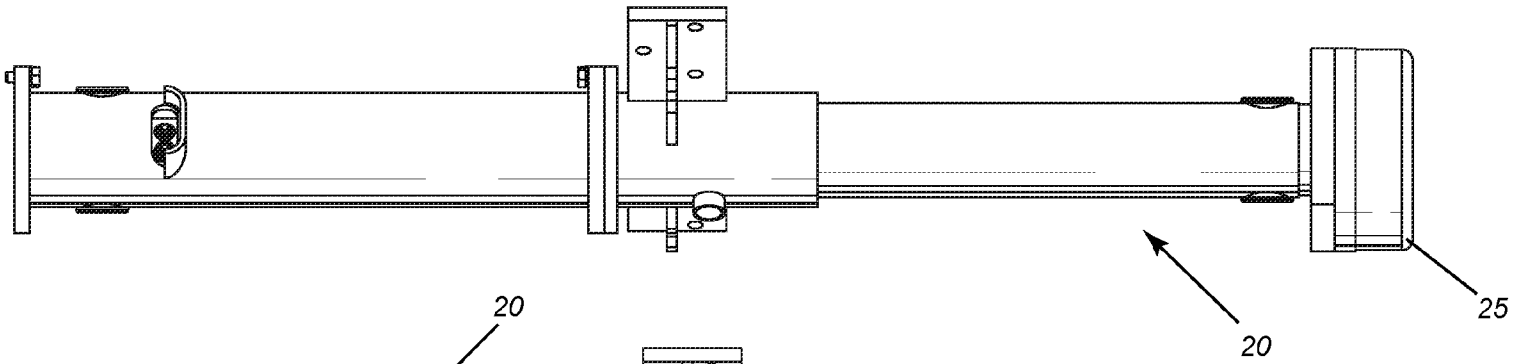
FIG. 5 is a side view of a hydraulic stinger in its extended posture.
Figure 6:
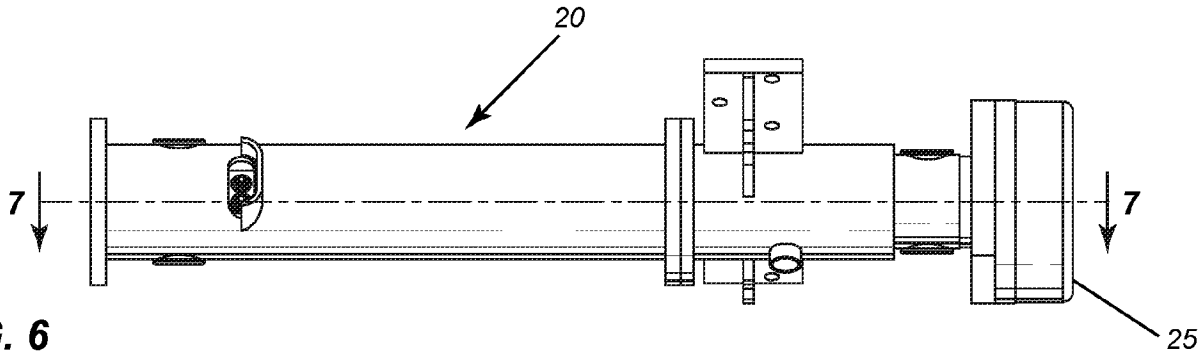
FIG. 6 is a side view of the hydraulic stinger in its retracted posture.

FIG. 5 is a side view of a first embodiment of the hydraulic stinger 20, shown in its extended posture while FIG. 6 shows the same embodiment of the hydraulic stinger in its retracted posture. The forward end of the stinger has a bumper pad 25, as shown in the figures, for engaging/stinging the rock face.

FIG. 7 is a cross-sectional view of the hydraulic stinger in its retracted posture. FIG. 7 is a cross-sectional view taken through section line 7-7 of FIG. 6.

FIG. 8 is an exploded view of the hydraulic stinger. In the embodiment of FIGS. 5-8, the stinger has a flanged support tube 21, an inner tube 22, a hydraulic cylinder (actuator) 23, one or more bearing plates 24, and the bumper pad 25.

In the second embodiment shown in FIGS. 9 and 10, the hydraulic cylinder 23 functions as the support tube. Therefore, the support tube may be eliminated if a lighter design is preferred. FIG. 9 is a side view of this second embodiment of the hydraulic stinger shown in a retracted posture whereas FIG. 10 shows this stinger in its extended posture.

Method of Rock Bolting

The foregoing rock bolter (or rock bolting system) enables a novel method of rock bolting. This method comprises independently extending the hydraulic stinger to engage (or "sting") a rock face while the drill feed and bolting feed remain retracted. While the hydraulic stinger is still extended, i.e. still stinging the face, the method then involves independently extending the drill feed. The hole is then drilled in the rock with the hydraulic stinger engaging (stinging) the rock face. Once drilling is complete, the drill is withdrawn. The system is indexed to rotate the bolting feed into alignment with the hole. This is done with the hydraulic stinger still engaging (stinging) the rock face. The method then entails installing a rock bolt into the hole using the bolting feed.

Figure 13:
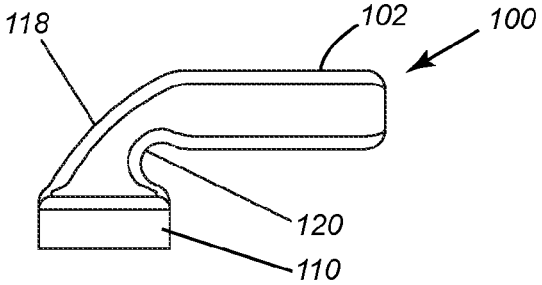
FIG. 13 is a side view of the bolt centralizer of FIG. 11 in its flexed posture.

In one embodiment of this method, a flexible bolt centralizer is used to guide the bolt. The bolt centralizer is made of a flexible elastomeric material that is attached to a sliding carriage for traveling over the rails of the bolting feed. The bolt is advanced through the bolt centralizer until the advancing bolting feed of the rock bolt causes the bolt centralizer to fold flexibly into a substantially orthogonal posture (as shown in FIG. 13) to permit the rock bolt to be advanced all the way to the rock face.

The method may further involve installing a replacement centralizer when the centralizer is damaged, loses its elasticity or becomes worn out. The detachable bolt centralizer may be detachably mounted (e.g. fastened) to the sliding carriage of the bolting feed via holes in a base of the bolt centralizer.

In a further embodiment, the method comprises mounting a screen-gripping attachment to the hydraulic stinger, gripping a screen with the screen-gripping attachment on the stinger, placing the screen against a rock face by extending the stinger and affixing the screen to the rock face. Gripping the screen may be done by hydraulically extending a plurality of finger extensions to grip the screen. This is described below in greater detail with reference to FIG. 15.

Flexible Bolt Centralizer

Optionally, the rock bolter may include a novel flexible bolt centralizer mounted on sliding carriage that travels on rails of the bolting feed 40.

Figure 14:
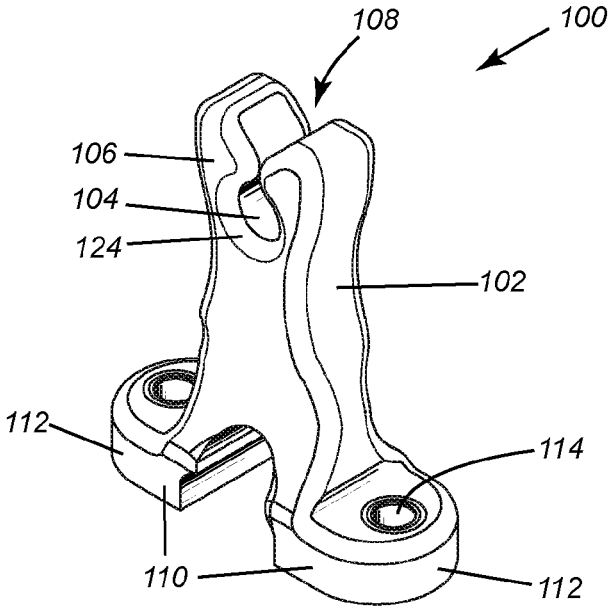
FIG. 14 is an isometric view of the bolt centralizer of FIG. 11.
Figure 11:
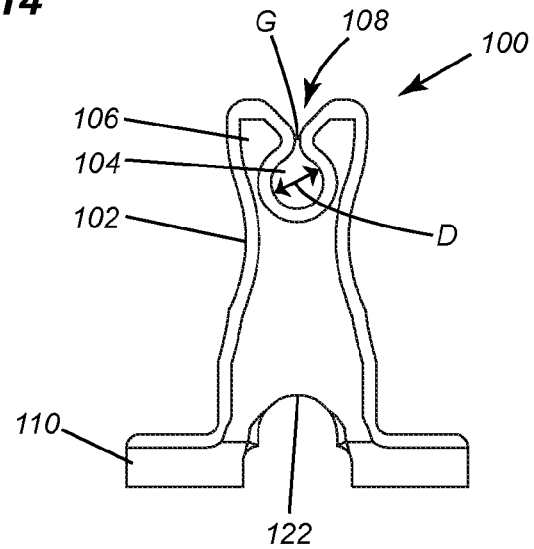
FIG. 11 is a front view of a bolt centralizer in accordance with an embodiment of the present invention.
Figure 12:
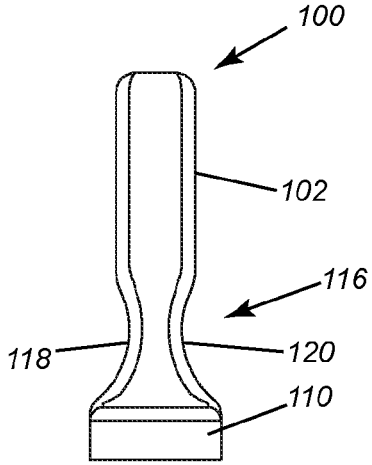
FIG. 12 is a side view of the bolt centralizer of FIG. 11 in its upright posture.

FIG. 11 is a front view of a flexible traveling bolt centralizer 100 in accordance with an embodiment of the present invention. FIG. 12 is a side view of the traveling centralizer in its upright posture whereas FIG. 13 is a side view of the traveling centralizer in its flexed or bent posture. FIG. 14 is an isometric view of the traveling centralizer in its upright posture.

As depicted in FIGS. 11-14, the bolt centralizer has a flexible body 102 capable of elastically flexing from an upright posture (FIG. 12) to a folded, flexed or bent posture (FIG. 13) which may be, in some embodiments, substantially orthogonal to the upright posture. In the upright posture, the bolt centralizer centralizes or guides the rock bolt into the drilled hole. In the flexed, bent or folded posture, the bolt centralizer permits the bolting feed of the rock bolter to pass by the centralizer. The flexure of the traveling bolt centralizer is designed to bend or flex in response to the force imposed on the centralizer by the bolting feed as it advances.

The traveling centralizer 100 comprises a passage 104 for guiding the rock bolt into a hole drilled by the rock bolt system. This passage may be formed two finger-like members 106 or upwardly curving projections that may be spread apart to receive the bolt. The finger-like extensions are elastically biased to return to the generally closed posture shown in the figures. The passage may define a generally circular aperture to guide a rock bolt that has a generally circular shaft. In the illustrated embodiment, the finger-like members are (at rest) spaced apart by a gap G that is substantially smaller than a diameter D of the generally circular aperture. Above the gap G is a generally V-shaped mouth 108.

The traveling centralizer 100 includes a base 110 for fastening the traveling centralizer to a sliding carriage (shown in FIG. 18) that slides on the rails of the bolting feed (as shown in FIGS. 20-24). As shown in FIGS. 11-14, the base may include two lobes 112 (i.e. feet, pads, or flange-like extensions) that contain holes 114 through which fasteners are inserted to fasten the centralizer to the rail-mounted carriage on the bolting feed. In variants, the number of holes, the shape of the lobes and/or the placement of the holes and lobes may be varied.

The centralizer may include a double concave body profile 116 to facilitate bending of the centralizer from an upright posture (FIG. 12) to a flexed, bent or orthogonal posture (FIG. 13). The double concave body profile includes a front concavity 118 and a rear concavity 120. The front and rear concavities may be symmetrical when the body is upright and not flexed as shown in FIG. 12. Beneath the double concave profile is an archway 122 as shown in FIG. 11.

In one embodiment, the flexible body is elastomeric. In one specific embodiment, the flexible body is made of urethane although it will be appreciated that similar materials may be substituted.

To minimize wear and prolong service life, the traveling bolt centralizer 100 may include a metal liner 124 in the passage. The metal liner may be a steel or stainless sleeve (or other suitable metal, alloy, or composite). This sleeve may be detachably fastened to the centralizer so it can be inspected, replaced, cleaned, serviced or repaired. For example, the sleeve may be bolted, screwed or otherwise fastened to the centralizer using fasteners.

As shown in the embodiment depicted in FIG. 14, the traveling bolt centralizer 100 has a base having two spaced-apart holes that are substantially orthogonal to the passage. The holes are designed to receive fasteners for fastening the centralizer to the sliding carriage of FIG. 18 which is designed to travel on the rails of the bolting feed.

Screen Handler

Optionally, the rock bolter may include a screen handler in the form of a screen-gripping (or screen-handling) attachment.

Figure 15:
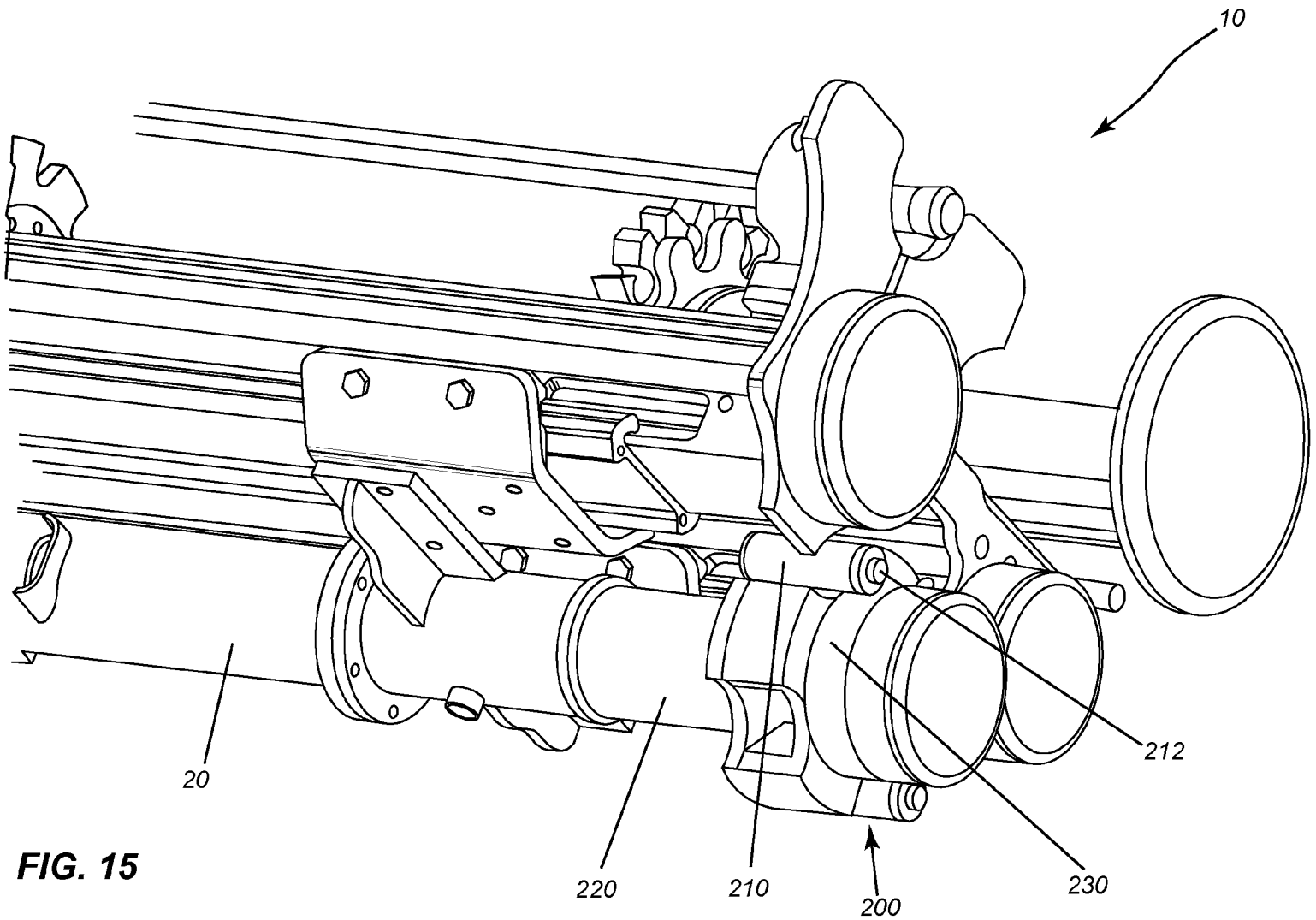
FIG. 15 is an isometric view of a screen-gripping attachment for mounting to an end of the hydraulic stinger for handling screens in accordance with another embodiment of the present invention.

FIG. 15 is an isometric view of a screen-gripping attachment 200 for mounting to an end of the hydraulic stinger 20 of the rock bolter 10. This screen-gripping attachment is an accessory that may optionally be mounted to a distal (working) end of the stinger to enable the stinger to grip (or handle) screens. As is known in the mining industry, wire mesh screening is installed in mines as another form of ground support, to prevent loose rocks from falling. As illustrated in FIG. 15, the screen-gripping attachment 200 includes gripping members which may be in the form of screen-gripping finger extension cylinders 210 and extension fingers 212. These extension fingers 212 are hydraulically actuated by the cylinders 210 to extend and engage a wire mesh screen. A rotary actuator 220 is provided to rotate the screen. A free-wheeling rotation housing 230 supports the rotary actuator to permit the rotary actuator and the finger extensions to rotate relative to the stinger. The stinger itself may extend and retract. With the rotary actuator 220, the stinger is able to both translate and rotate the screen gripped by the extensions fingers 212. The bolting feed may be used to insert a bolt into the rock face to fasten the screen in place while the stinger is holding the screen against the rock face.

Operation of Rock Bolter with Flexible Centralizer

Figure 16:
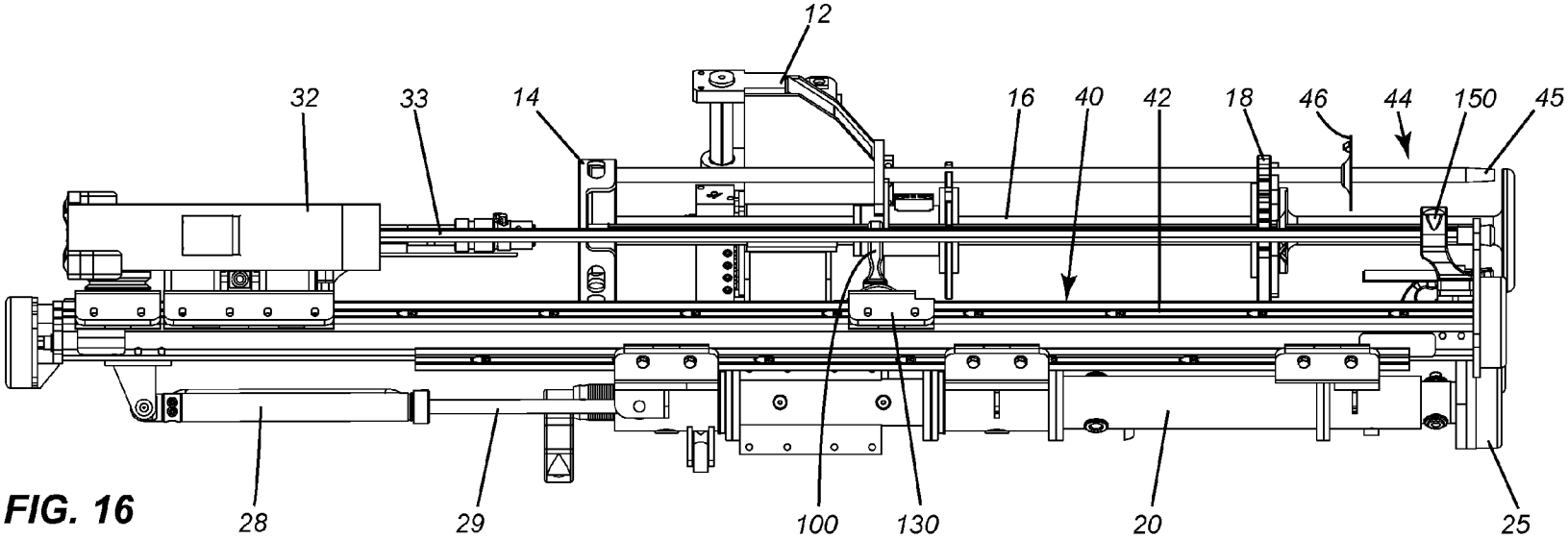
FIG. 16 is a side view of the rock bolter with a flexible traveling centralizer and a flexible forward centralizer mounted to the bolting feed.
Figure 17:
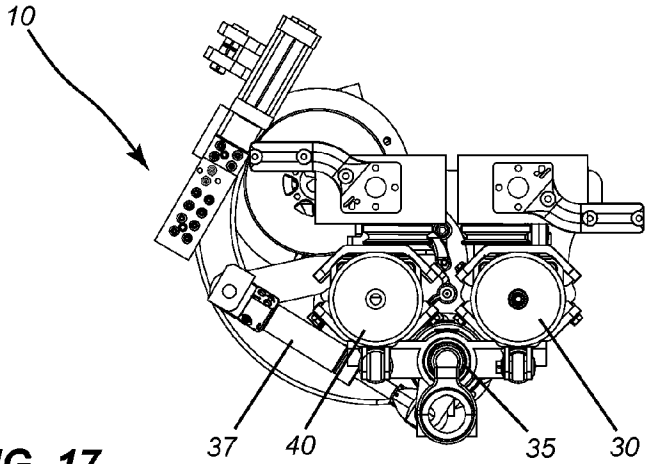
FIG. 17 is a rear view of the rock bolter of FIG. 16.

FIGS. 16 and 17 are side and rear views, respectively, of the rock bolter 10 having two bolt centralizers 100, 150. In the embodiment depicted in these figures, the rock bolter includes both a flexible traveling centralizer 100 and a flexible stationary centralizer 150 mounted to a forward end 41 of the rails 42 of the bolting feed 40.

FIG. 16 shows the hydraulic stinger 20 and its forward bumper pad 25. The rock bolter 10 includes a feed extension cylinder 28 and piston rod 29 for extending and retracting the hydraulic stinger.

FIG. 16 also shows that the rock bolter 10 includes a mounting frame 12 for mounting the rock bolter to a boom, platform, or other such structure. The rock bolter includes a carousel 14, a turret 16, and an indexing mechanism 18.

The drill feed 30 includes a rock drill 32 and drill steel 33 that extends to the drill bit. The drill bit is advanced by the drill feed to drill the hole in the rock face. After indexing using the indexing mechanism, the bolting feed 40 then drives a bolt 45 into the hole that was drilled by the drill bit of the drill feed. The bolt 45 may include a bolt plate 46. The bolt plate 46 of the rock bolt is the end plate (flange, washer or head) of the bolt that abuts the rock face when the rock bolt is inserted into the hole.

As depicted in FIG. 17, the indexing mechanism 18 indexes the bolting feed into alignment with the drilled hole by rotating the bolting feed about a center of rotation 35. As depicted by way of example in FIG. 17, the center of rotation 35 is offset relative to the two parallel axes of the drill feed and the bolting feed, i.e. the center of rotation lies between and below the drill feed 30 and the bolting feed 40 as shown in FIG. 17. The indexing mechanism 18 includes an indexing cylinder 37 (i.e. a hydraulic actuator) that indexes the drill feed and bolting feed by rotating the drill feed and bolting feed about the center of rotation 35 such that the bolting feed is moved into alignment with the hole drilled by the drill feed.

Figure 18:
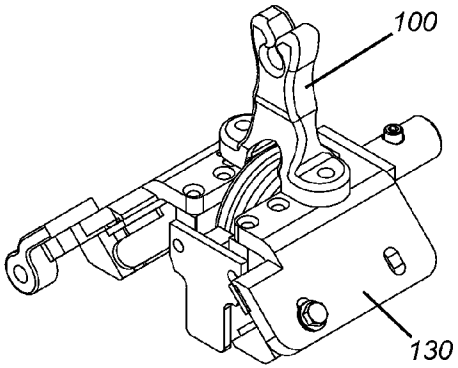
FIG. 18 is an isometric view of the traveling centralizer mounted to the rock bolter.

FIG. 18 is an isometric view of the flexible traveling centralizer 100 and its sliding carriage 130 that is adapted to be mounted to the rails 42 of the bolting feed of the rock bolter 10. The flexible traveling centralizer 100, which may be made of urethane or any other suitable elastomeric material, rides on a sliding carriage that slides over the rails of the bolting feed. As depicted by way of example in FIG. 18, the sliding carriage may include a plurality of spaced-apart threaded bores that align with the holes in the base of the traveling centralizer, permitting threaded fasteners to be inserted through the holes of the centralizer and into the threaded bores in the carriage. The carriage may include a wheel that rolls along a surface of the bolting feed as the carriage is advanced and retracted. By supporting at least part of the weight of the carriage, the wheel helps to provide a smoother motion for the carriage as it slides over the rails. It will be noted that the wheel rotates in the space defined by the archway 122 introduced in FIG. 11.

Figure 19:
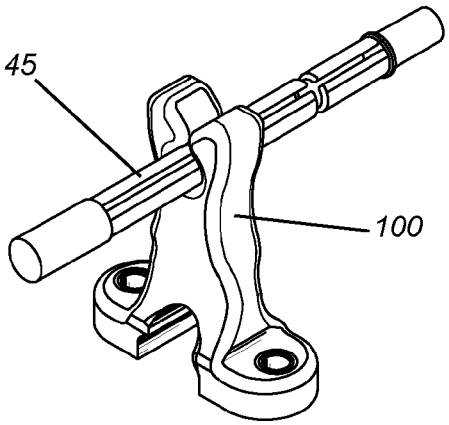
FIG. 19 is an isometric view of the traveling centralizer with a bolt in the passage.

FIG. 19 is an isometric view of the flexible traveling centralizer 100 with a bolt 45 in the passage of the flexible traveling centralizer. The flexible traveling centralizer acts in concert with the flexible stationary centralizer to provide a two-point support for the bolt 45 to guide the bolt 45 into the hole that has been drilled. As shown in FIGS. 20-24, the flexible traveling centralizer 100 bends or folds out of the way as the bolting feed 40 is advanced. Due to its elasticity, the traveling centralizer 100 returns to its original upright posture after the bolting feed 40 has been retracted. Due to its shape and material, the flexible traveling centralizer 100 is able to undergo a large number of bending-unbending cycles before it needs to be replaced.

Figure 20:
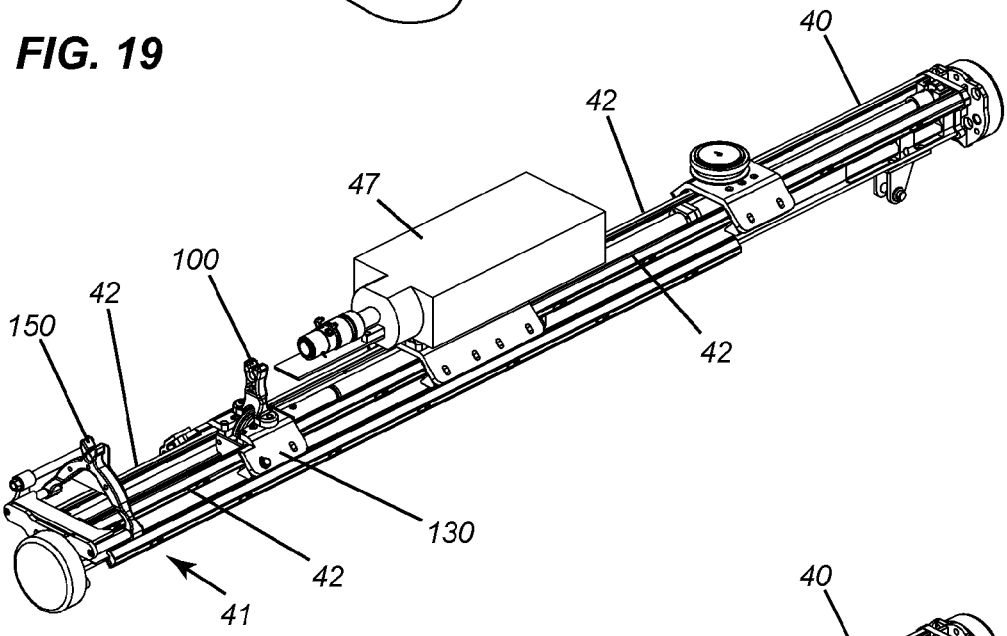
FIG. 20 is an isometric view of a rail-mounted bolting feed having a traveling centralizer mounted on rails and a stationary centralizer mounted at a forward end of the rails.
Figure 21:
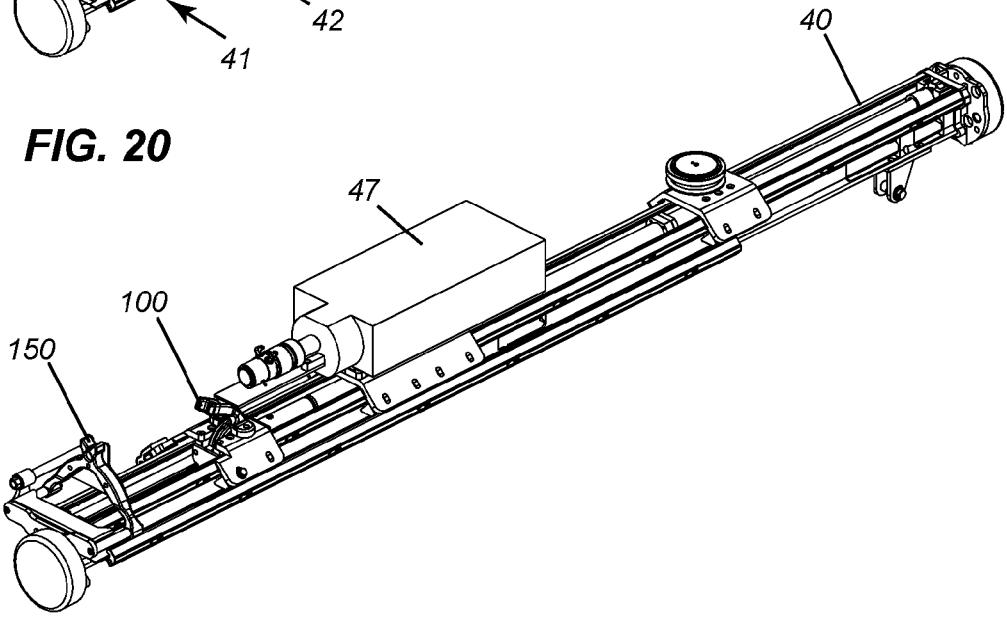
FIG. 21 is an isometric view of the traveling centralizer as it flexes.
Figure 22:
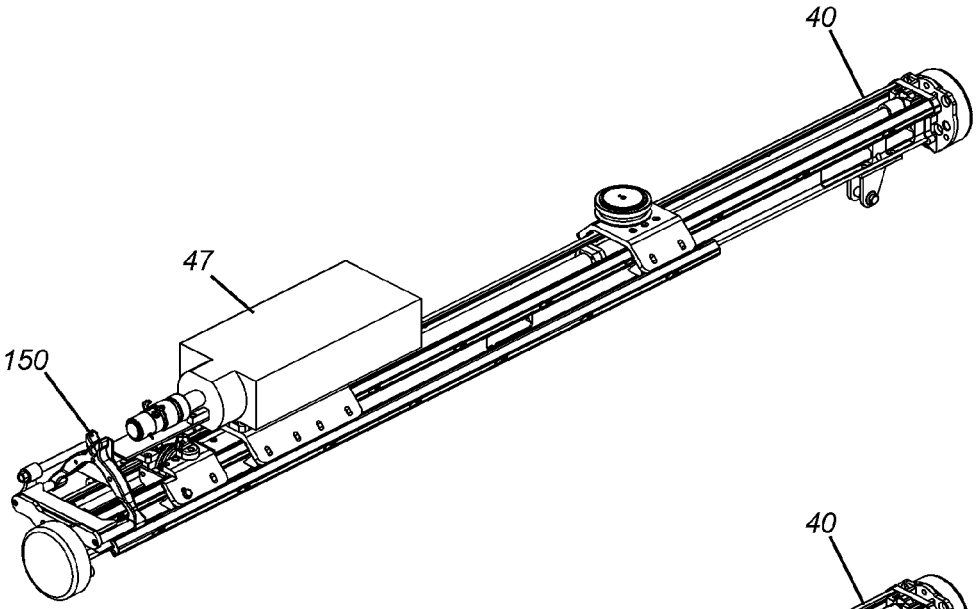
FIG. 22 is an isometric view of the traveling centralizer as it is completely bent/folded.
Figure 23:
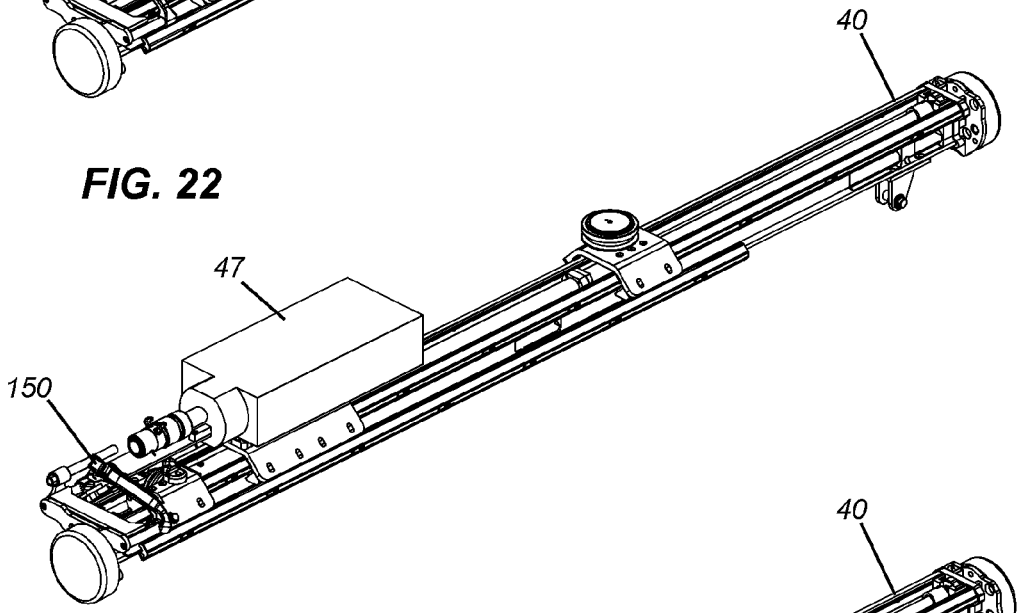
FIG. 23 is an isometric view of the forward centralizer as it too flexes as the bolting feed advances.
Figure 24:
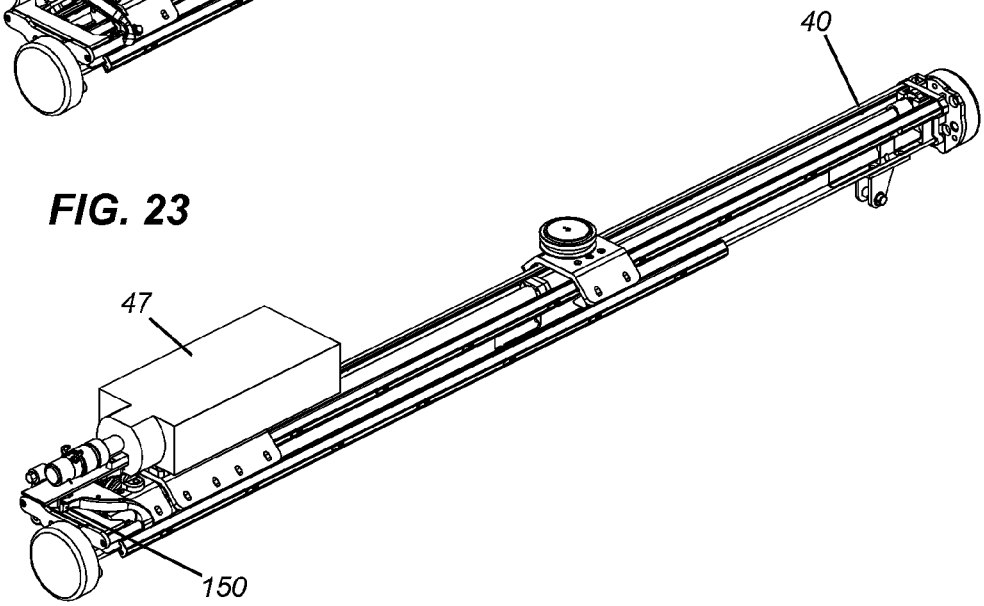
FIG. 24 is an isometric view of the forward centralizer as it is completely bent/folded.

FIGS. 20-24 depict the operation of these flexible centralizers 100, 150 as the bolting feed 40 is advanced on its rails 42. FIG. 20 shows a rail-mounted bolting feed 40 having a traveling centralizer 100 mounted on rails 42 and a stationary centralizer 150 mounted at a forward end 41 of the rails 42. A bolt (not shown) extends from the bolt magazine 47 of the bolting feed 40. FIG. 21 shows how the traveling centralizer 100 flexes as the bolting feed 40 advances on its rails 42. FIG. 22 shows how the traveling centralizer 100 is then completely bent/folded/flexed as the bolting feed passes over top of the centralizer 100. FIG. 23 shows how the forward stationary centralizer 150 also flexes as the bolting feed 40 advances toward its maximum extension along the rails 42. It is noteworthy that the stationary centralizer has a different body structure than the traveling centralizer. The stationary centralizer has two legs with a wide stance that spans the rails. However, the stationary centralizer has two finger-like extensions that define a V-shaped mouth and a passage for receiving the bolt, which may be similar to finger-like extensions, V-shaped mouth and passage of the traveling centralizer. FIG. 24 shows the forward centralizer 150 completely bent/folded when the bolting feed reaches its maximum extension along the rails 42.

The invention described above thus provides a number of improvements in the realm of rock bolting. The independently movable stinger, drill feed and bolting feed greatly facilitate the task of installing rock bolts in a rock face. The stinger may furthermore be used, with a screen-gripping attachment, to install protective screening. The flexible centralizer provides a novel design for both the traveling centralizer and the forward, stationary centralizer, eliminating the need for complex centralizer mechanisms. Each of these improvements facilitates, and renders more efficient, the installation of rock bolts in a mine.

The present invention has been described in terms of specific embodiments, examples, implementations and configurations which are intended to be exemplary or illustrative only. Other variants, modifications, refinements and applications of this innovative technology will become readily apparent to those of ordinary skill in the art who have had the benefit of reading this disclosure. Such variants, modifications, refinements and applications fall within the ambit and scope of the present invention. Accordingly, the scope of the exclusive right sought by the Applicant for the present invention is intended to be limited solely by the appended claims and their legal equivalents.

The invention claimed is:

1. A rock bolting system comprising:

a hydraulic stinger for engaging a rock face to stabilize the rock bolting system;

a drill feed for drilling a hole in the rock face; and a bolting feed for installing a rock bolt into the hole, wherein the hydraulic stinger, the drill feed and the bolting feed are each independently extendable and retractable, wherein the bolting feed comprises a bolt centralizer made of a flexible elastomeric material that includes a passage for receiving and guiding the bolt into the hole and wherein the bolt centralizer folds elastically when the bolting feed advances against the bolt centralizer.

2. The rock bolting system as claimed in claim 1 wherein the hydraulic stinger is extendable to sting the rock face while the drill and bolting feeds remain retracted, wherein the drill feed is extendable to drill the rock face while the stinger remains extended against the rock face and the bolting feed remains retracted, and wherein the drill feed is retractable after drilling a hole in the rock face and the bolting feed is extendable to insert the rock bolt into the hole while the stinger still remains extended against the rock face.

3. The rock bolting system as claimed in claim 1 wherein the hydraulic stinger comprises a hydraulic actuator, a bearing plate connected to a distal end of the actuator, and a bumper pad affixed to the distal face of the bearing plate.

4. The rock bolting system as claimed in claim 1 wherein the bolt centralizer comprises a base having holes for fasteners to fasten the centralizer to a sliding carriage adapted to slide over rails of the bolting feed, an upright flexible body extending upwardly from the base to form two inwardly biased finger-like members that may be spread apart to insert the bolt into the passage.

5. The rock bolting system as claimed in claim 4 wherein the upright body comprises a double concave body profile to facilitate bending of the centralizer from an upright posture to an orthogonal posture.

6. The rock bolting system as claimed in claim 1 wherein the hydraulic stinger further comprises a screen-gripping attachment for gripping a screen.

7. The rock bolting system as claimed in claim 6 wherein the screen-gripping attachment comprises a plurality of finger extension cylinders for gripping the screen.

8. A method of installing ground support using a rock bolting system having a hydraulic stinger, a drill feed, and a bolting feed, the method comprising:

independently extending the hydraulic stinger to engage a rock face while the drill feed and bolting feed remain retracted;

while the hydraulic stinger is extended, independently extending the drill feed;

drilling a hole in the rock with the hydraulic stinger engaging the rock face;

indexing the system to rotate the bolting feed into alignment with the hole with the hydraulic stinger engaging the rock face; and installing a rock bolt into the hole using the bolting feed by feeding the bolt through a bolt centralizer made of a flexible elastomeric material by advancing the bolting feed until the bolting feed causes the bolt centralizer to fold elastically.

9. The method as claimed in claim 8 comprising fastening a detachable bolt centralizer to a sliding carriage adapted to travel on rails of the bolting feed via holes in a base of the bolt centralizer, wherein the bolt centralizer comprises a flexible elastomeric body enabling the bolt centralizer to flex between an upright posture for guiding the bolt to a folded posture that is substantially orthogonal to the upright posture.

10. The method as claimed in claim 8 further comprising:

after installing the rock bolt, retracting the hydraulic stinger and mounting a screen-gripping attachment to the hydraulic stinger;

gripping a screen with the screen-gripping attachment on the stinger;

placing the screen against the rock face by extending the stinger; and affixing the screen to the rock face.

11. The method as claimed in claim 10 wherein gripping the screen comprises hydraulically extending a plurality of finger extensions to grip the screen.

* * * * *